United States Patent [19]

Crudgington, Jr.

[11] Patent Number: 4,875,394

[45] Date of Patent: Oct. 24, 1989

[54] CHAMPAGNE BOTTLE OPENER

[76] Inventor: Cleveland B. Crudgington, Jr., 222 N. Myrtle Ave., Monrovia, Calif. 91016

[21] Appl. No.: 895,204

[22] Filed: Jun. 19, 1986

Related U.S. Application Data

[63] Continuation-in-part of Ser. No. 786,545, Oct. 11, 1985, abandoned.

[51] Int. Cl.[4] ..... B67B 7/02

[52] U.S. Cl. ..... 81/3.08; 81/3.36; 81/3.55; 81/417

[58] Field of Search ..... 81/3.36, 3.08, 3.37, 81/3.39, 3.55, 3.09, 302, 415, 416, 417; 29/268

[56] References Cited

U.S. PATENT DOCUMENTS

| | | | |
|---|---|---|---|
| 478,009 | 6/1892 | Hollis | 81/302 |
| 1,085,461 | 1/1914 | Michaelis | 29/268 |
| 1,728,418 | 9/1929 | Litchfield | 81/3.36 UX |
| 2,761,338 | 9/1956 | Hardy . | |
| 3,656,375 | 4/1972 | Reed et al. | 81/3.55 |
| 3,722,327 | 3/1973 | Strassel | 81/3.36 X |
| 3,800,345 | 4/1974 | Feliz | 81/3.08 |
| 4,018,110 | 4/1977 | Spriggs | 81/3.08 |
| 4,387,609 | 6/1983 | Polsfuss | 81/3.36 |
| 4,422,355 | 12/1983 | Burns | 81/3.46 |

FOREIGN PATENT DOCUMENTS

| | | | |
|---|---|---|---|
| 53681 | 9/1937 | Denmark | 81/417 |
| 25798 | 2/1953 | Finland | 81/3.09 |

*Primary Examiner*—Roscoe V. Parker

[57] ABSTRACT

Improvements in a hand manipulable device with bifurcated jaws for removing mushroom shaped stoppers from sparkling beverage bottles wherein each jaw contains a recess enabling the device to be repositioned directly around the stopper's stem and on top of the bottle when the stopper has been partially removed, thereby providing a means for additional leverage and lift capability; pivotally interconnected upper and lower levels which are interlocked, thereby eliminating the likelihood that the pivot action might be either too tight or too loose, and enabling the insertion of a hidden spring which eliminates the need for an exposed and perhaps hazardous spring between the handles; and without an exposed spring, grip means is permitted beneath the handles that provides an alternate method of stopper removal; the addition of clips to the upper jaw to prevent the stopper from ricocheting out from under the retaining arm; and a retaining arm which is either flexible or movable thereby permitting a downwardly directed and manually exerted counter force to be applied to said stopper, enabling the stopper to be removed slowly, if desired.

14 Claims, 2 Drawing Sheets

CHAMPAGNE BOTTLE OPENER

REFERENCES CITED

Earlier Filed Application

This application is a continuation-in-part of patent application 06/786,545 filed 10/11/85, Group Art 323 and now abandoned.

| | | | |
|---|---|---|---|
| 1,728,418 | 9/1929 | Litchfield | 81/3.36 UX |
| 2,761,338 | 9/1956 | Hardy | 81/3.38 R |
| 3,656,375 | 4/1972 | Reed | 81/3.55 |
| 3,722,327 | 3/1973 | Strassel | 81/3.36 X |
| 3,800,345 | 4/1974 | Feliz | 81/3.1 R X |
| 4,018,110 | 4/1977 | Spriggs | 81/3.08 |
| 4,387,609 | 6/1983 | Polsfuss | 81/3.36 |
| 4,422,355 | 12/1983 | Burns | 81/3.46 |

BACKGROUND AND OBJECTS OF THE INVENTION

1. Field of the Invention

The present invention relates generally to hand manipulable devices for removing either cork or plastic mushroom shaped stoppers from champagne and other sparkling beverage bottles, comprising upper and lower bifurcated jaws engageable about the neck of the bottle, whereby the squeeze of the handles results in the spreading of the jaws, which in turn serves to remove the stopper. The present invention relates more particularly to certain new and useful improvements in such pullers for removing mushroom shaped stoppers.

2. Description of the Prior Art

Previously depicted stopper removers of the bifurcated jaw type have a number of disadvantages that make them less functional and reliable than they could be. The device representing the bifurcated jaw configuration depicted in prior art is illustrated in FIG. 1.

The retaining arm 7 is shown as rigid member that comes over the top of the stopper. Because of the variety of bottle and stopper configurations, the retaining arm must provide ample clearance for many stoppers. However, this clearance often enables some stoppers, upon their release, to ricochet from under the retaining arm and fly out of the extractor in a horizontal direction. Several modifications disclosed herein will eliminate this and other disadvantages as well.

Even though the spring 6 between the handles provides a necessary function, most exposed springs can cause pinched skin or fingers. A modification to the extractor enables the spring to be hidden and no longer a threat to this type of injuries.

The method depicted for hinging upper and lower levers 2 and **2*a* is functional, however an improved hinge mechanism will eliminate any possibility of the levers ever being either too tight or too loose at the pivotal interconnection 5**.

Stopper removers of the bifurcated jaw type can be used with most stopper and bottle configurations, however certain stoppers made from cork cannot be removed without first being twisted to break the seal. A modification to the handles allows this type of remover to rotate all such stoppers.

Several modifications to the upper and lower jaws provide a considerable improvement in the operation of the extractor. One such modification allows the remover to be repositioned in a novel way which provides additional leverage and lift to the stopper. This and other modifications to the jaws are disclosed in my invention.

3.Objects of the Invention

The mechanical stopper removers of the aforementioned type heretofore known have numerous limitations. A general object of my invention is to address these limitations and provide improvements in each case.

Specifically, one object is to provide a generally "U" shaped recess within the interiors of both the upper and lower bifurcated jaws so that additional lift action can be provided by resting the lower jaw directly on top of the bottle after the stopper has been partially lifted, instead of being limited to seating the lower jaw only on the shoulder surrounding the bottle neck;

Another object is to provide a secondary means to remove stoppers by adding a grip means between the handles so that stoppers, which are difficult to remove by implementation of the bifurcated jaw means, particularly those made of cork, may be gripped between the handles and then rotated, thereby allowing the twisting action to break the seal between cork stopper and bottle;

Another object is to provide an improved hinge mechanism that eliminates any possibility of the stopper remover from binding at its pivot point, or becoming unnecessarily loose, thereby resulting in a "sloppy" action between the two pivoting levers;

Another object of the present invention is to provide an improved hinge mechanism which includes within its interior, a small flat spring that replaces the exposed spring between the the handles, an exposed spring which may cause pinching of the operator's hand or fingers;

Another object of the present invention is to provide a stopper retaining device which is in the shape of a hood thereby enabling the stopper remover to provide some protection against spraying of the beverage while opening;

Another object of the present invention is to provide a stopper retaining device which can be pressed downward against the top of the stopper, thereby providing the means for the controlled release of the stopper;

Another object of the present invention is to provide one or more spring loaded clips to the upper bifurcated jaw in addition to a retaining arm or hood, for the purpose of holding the stopper's head, thereby eliminating the possibility that some stoppers may on occasion ricochet out from the underside of the retaining member.

DESCRIPTION OF DRAWINGS

In the drawings:

FIG. 2 is a perspective view of the stopper remover.

FIG. 3 is a partial side elevation of the remover with its pair of jaws positioned for extracting a stopper.

FIG. 4 is an end view of the remover with its jaws in position for removing a typical stopper made from cork.

FIG. 5 is a partial top view of the remover with its shield partially cutaway for viewing the upper jaw.

FIG. 6 is an end view of the remover with its jaws in position for removing a typical stopper made from plastic.

FIG. 7 shows a full side view of the stopper remover with stopper retainer and handle modifications.

FIG. 8 shows a full top view of the stopper remover without its stopper retaining device, illustrating a modified jaw configuration.

FIG. 9 is a side sectional elevation (s-s) of FIG. 5 illustrating the modified hinge of the stopper remover.

FIG. 10 is a cross sectional elevation (c-c) of FIG. 3 showing the same hinge modification in FIG. 9.

DESCRIPTION OF THE PREFERRED EMBODIMENT

Whereas the preferred configuration of the improvements relating to the invention, has been shown and described herein, it should be realized that there are many modifications, substitutions and alterations thereto. The embodiments are therefore to be considered in all respects as illustrative and not restrictive.

Figure 1:
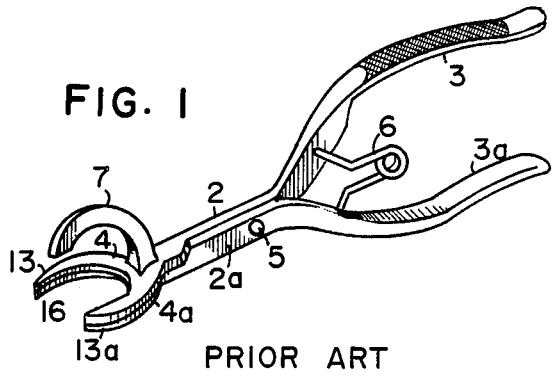
FIG. 1 is a perspective view of a stopper remover of the bifurcated haw type constructed according to the prior art.

FIG. 1 illustrates a stopper remover of the bifurcated jaw type claimed by Spriggs'U.S. Pat. No. 4,018,110, and provides the basis for improvements claimed within my patent.

Figure 2:
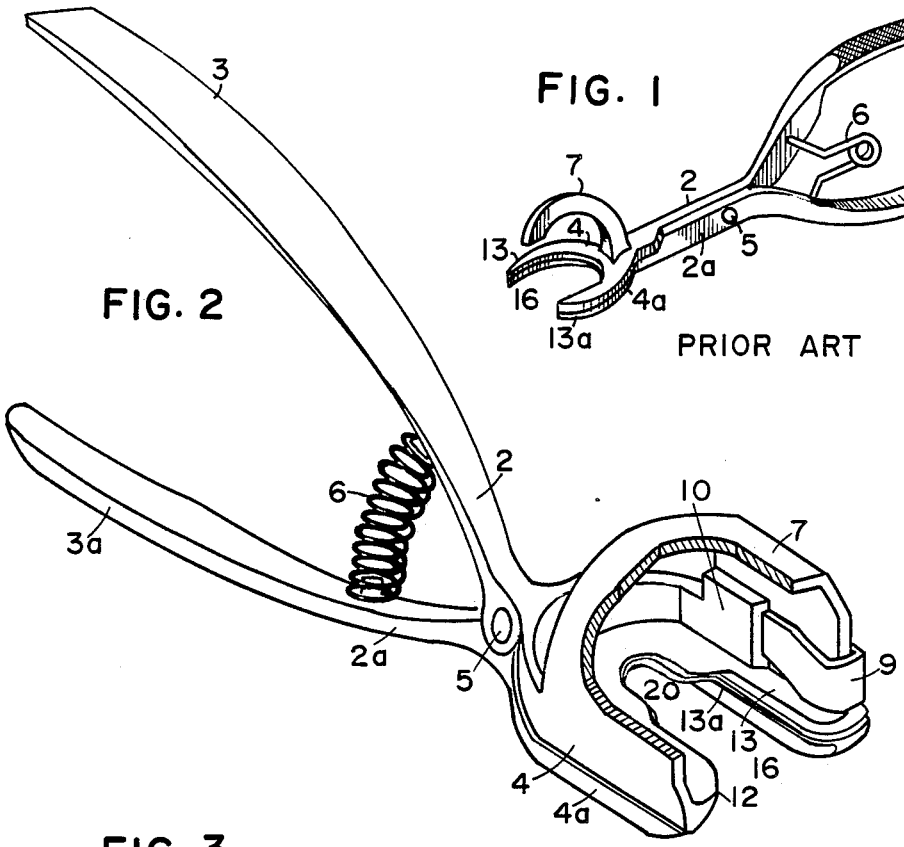
PRIOR ART FIG. 2
FIGS. 2 through 10 incorporate the modifications contained within the preferred embodiment of the present invention.

Referring to the drawings and first to FIGS. 1 and 2, the bifurcated stopper extractor 1 is comprised of a pair of levers 2 and 2*a*. At one end the levers 2 and 2*a* for a pair of handles 3 and 3*a*, and at the opposite end, they form a pair of bifurcated jaws 4 and 4*a*. The pair of levers 2 and 2*a* are joined by a pivot pin assembly 5, so that the squeezing together of the pair of handles 3 and 3*a* causes the opening of jaws 4 and 4*a*. Typically, a spring 6 is placed between the handles 3 and 3*a*, thus making the extractor easier to hold during placement. Also, the spring 6 returns the levers 2 and 2*a* to their original position after each use. A stopper retaining member 7, is affixed to the upper jaw 4, preventing the stopper 8 from flying into the air when released from the pressurized sparkling beverage bottle 8*b*.

Referring now to FIGS. 3, 4, 5, and 6, the stopper retaining member 7 is shown to be in the form of a hood 7. This configuration minimizes spray, if any, from the release of the pressurized beverage, in addition to impeding cork stoppers 8 and plastic stoppers 8*a* from flying into the air. The upper jaw 4 can be provided with one or more spring clips 9, mounted within the upper jaw 4, in this case on each side of hood 7. The clips 9 must be sufficiently flexible to allow the stopper 8 or 8*a* to be easily placed within the upper jaw 2*a*, yet must provide adequate tension to hold the stopper 8 or 8*a* during the opening process.

Each clip 9 can be held in place within a channel 10 molded into the hood 7, and can be anchored by a rivet 11.

The curvature 12 at the entrance of each pair of jaws 4 and 4*a* guides the stopper extractor 1 during its insertion around the bottle 8*b*. The interior of both jaws 4 and 4a contain blades 13 and 13*a*. The upper blade 13, in particular, has a tapered edge 14 which aids in grabbing cork stoppers 8 during the opening process. Both jaws 4 and 4*a* have ridges 15 and 15*a* around their perimeters that provide reinforcement to the blades 13 and 13*a*.

Both upper and lower blades 13 and 13*a* contain generally "U" shaped slots 16 and 16*a* that are in alignment with one another. The upper slot 16 is sufficiently wide to clear the diameter of the lip 17 found at the top of all conventional sparkling wine bottles 8*b*. Likewise, the upper slot 16 is sufficiently narrow to seize the downwardly presenting shoulder 18 of stoppers 8 and 8*a*, during the opening of the pair of jaws 4 and 4*a*.

Figure 3:
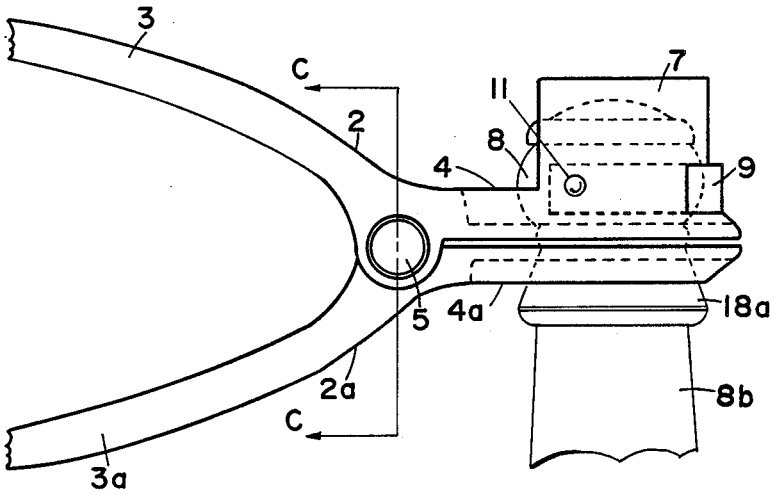
Figure 4:
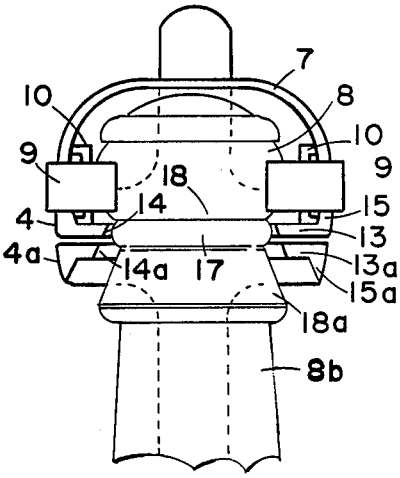
Figure 5:
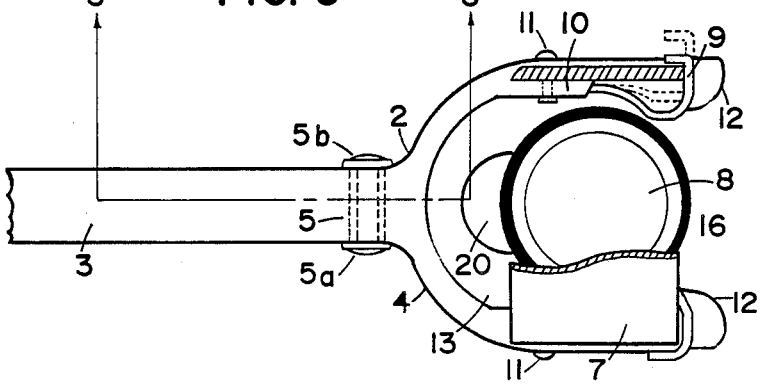
Figure 6:
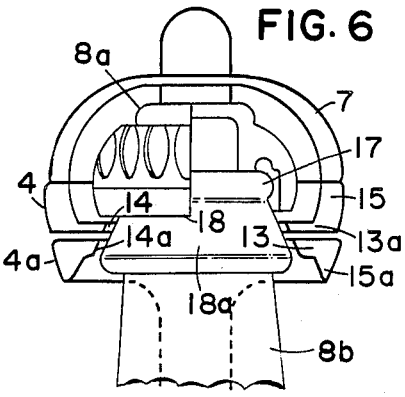

FIGS. 3, 4 and 6 illustrate the lower blade 13*a* in position for making contact with the upper surface of the glass shoulder 18*a* provided by all bottle manufactures to anchor the stopper's safety harness (not shown). The lower slot 16*a* must be sufficiently wide to fit around the lower portion of the shoulder's upper surface 18*a* to accommodate insertion under plastic stoppers 8*a* which typically overlap the bottle's lip 17. Yet, the lower slot 16*a* must not be so wide that the lower blade 13*a* slips down past the narrowest shoulder 18*a* commonly found on conventional champagne and sparkling beverage bottles. Furthermore, the upper and lower blades 13 and 13*a*, when brought together, must be sufficiently thin to be able to slide between the underside of any plastic stopper 8*a* and the upper surface of shoulder 18*a*. To further facilitate the pair of blades 13 and 13*a* to fit the limited space between the bottom of plastic stopper 8*a* and the bottle's shoulder 18*a*, as depicted in FIG. 6, the lower blade 13*a* is also provided with a tapered edge 14*a*.

Figure 7:
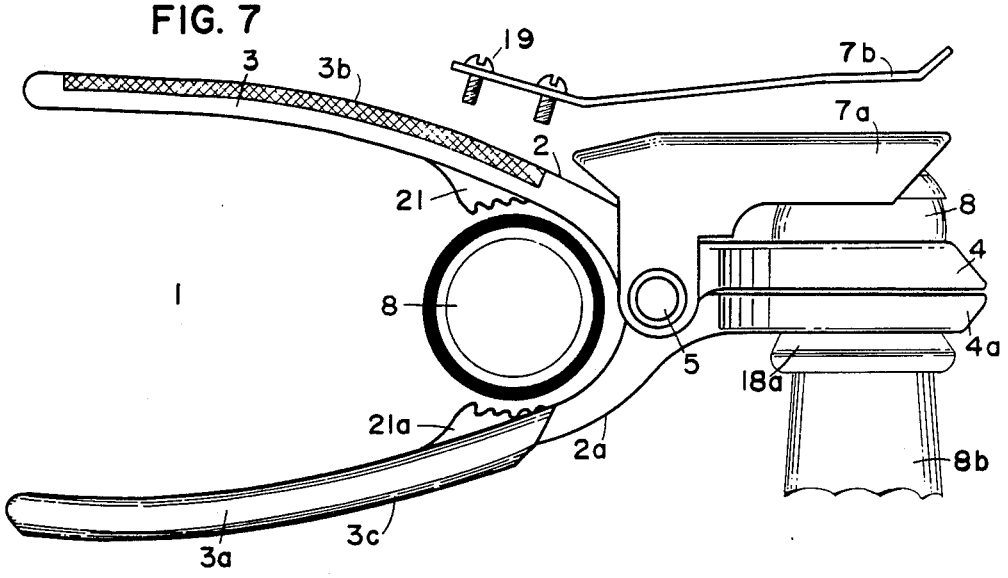

FIG. 7 illustrates the full length of stopper extractor 1. The suggested overall length the extractor 1 is approximately 17 to 18 cm. And the suggested overall width of the pair of handles 3 and 3*a* is 8.0 cm. These dimensions provide a stopper extractor which can be easily held and operated. The leverage capability of the stopper extractor 1 must be weighed against the required vertical lift provided by the spreading of the jaws 4 and 4*a*. As the leverage action is increased, the vertical travel, provided by the pair of jaws 4 and 4*a*, is correspondingly decreased. The illustration in FIG. 6 suggests an extractor with a leverage ratio such that when the handles 3 and 3*a* come together, they travel a distance of approximately 7.0 cm, and the jaws 4 and 4*a* will lift the stopper 8 or 8*a* about 2.5 cm. Even though the portion of the stopper 8 or 8*a* inserted within the bottle 9, may be longer than the lift provided, the bottle's carbonation will usually drive the stopper 8 or 8*a* the remaining distance from the bottle 8*b*. With the leverage ratio suggested herein, a moderate squeeze of the handles 3 and 3*a*, such as 15 pounds, will provide an upward pull on the stopper 8 or 8*a* of 280% or about 45 pounds.

Additionally, FIG. 7 illustrates an improvement to the design of the handles 3 and 3*a*, by the addition of a notched rib 21 to the underside of the upper handle 3*a* near the pivot assembly 5, and a similar notched rib 21*a* on the underside of the lower handle 3*a*. The pair of notched ribs 21 and 21*a* are dimensioned to grasp the head of a typical cork stopper 8 with the squeezing together of the pair of handles 3 and 3*a*. By grasping a particularly stubborn cork stopper 8 in this manner, the stopper 8 may be easily rotate while remaining in the bottle 8*b*, wherein the twisting action coupled with the internal pressure from the carbonated beverage will, at the very least, loosen the stopper 8. The stopper 8, if not completely removed using this means, may then be removed by the extractor 1 using the bifurcated jaws 4 and 4*a*.

FIG. 7 also illustrates several alternatives to the stopper retaining member 7, which enable the operator to press downward on the stopper 8 or 8*a* while providing the necessary vertical lift to remove the stopper 8 or 8*a*. A hood 7*a* made of a rigid material can be provided with limited pivotal movement. Through this means the released stopper 8 or 8a would be restricted, yet manual counter force could still be applied. Shielding may also be provided by a metal clip 7b having sufficient rigidity to restrain an extracted stopper 8 or 8a yet could be sufficiently flexible to permit the aforementioned counter force. Clip 7b is attached to the upper handle 3 with fasteners 19, and extends over the center of the upper jaw 4. In those situations where the wine connoisseur wishes to preserve carbonation by slowly releasing bottle pressure during the opening process, he is able to apply counter force to the stopper 8 or 8a by placing one hand over the retaining member 7a or 7b, then pressing downward while simultaneously exerting a vertical lift by squeezing the pair of handles 3 and 3a with his other hand. The hood 7 illustrated in FIGS. 1 through 5 could be made of a durable yet flexible material such as vinyl, thereby providing another means to apply this counter force to the stopper 8 or 8a. Because of the material's flexibility, as with retaining members 7 and 7b, or because of the member's movability, as with retaining member 7a, the retaining members 7, 7a or 7b, utilizing either method, will enable the application of a counter force. A variety of other modifications can be made without deviating from the embodiments of my invention. For example, as illustrated in FIG. 7, the handles 3 and 3a can be provided with a textured surface 3b or a plastic coating 3c to improve the hand grip.

Figure 8:
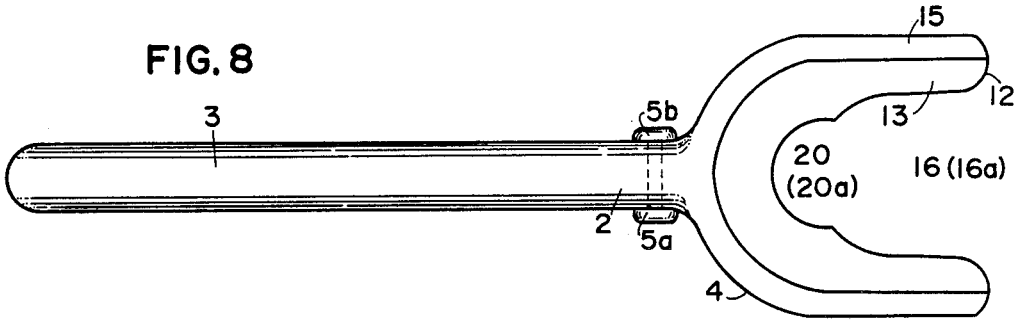

FIG. 8 illustrates a suggested modification to blades 13 and 13a, wherein an additional method is provided to position the stopper extractor 1 around the bottle 8b. In event the stopper 8 or 8a has not been fully dislodged with a full squeeze of the handles 3 and 3a using the extractor's positioning previously described, then the extractor 1 can be repositioned to complete the extraction process. The upper blade 13 is shown with a generally "U" shaped recess 20 which is added to slot 16 of the upper jaw 4. Likewise, the lower blade 13a is modified in like manner, having a similar recess 20a, which is aligned with upper recess 20. This modification to upper and lower blades 13 and 13a, addresses certain shoulder 18 and/or cork stopper 8 configurations which minimize effectiveness of the lift action. In either case additional lift action is often required to complete the removal of some cork stoppers 8. The recess 20 is sometimes mandatory for the upper blade 13 to gain an adequate hold on a small headed cork stopper 8. In this alternate position, the pair of jaws 4 and 4a are placed between the top of the bottle 8b and the underside of a partially dislodged cork stopper 8. Upper and lower blades 13 and 13a are fully inserted when the partially exposed stem (not shown) of stopper 8 or 8a is contained by recesses 20 and 20a. The depth of recesses 20 and 20a are such that they reach around each side of stopper 8 or 8a. The lower blade 13a now rests on top of the bottle's lip 17, while the upper blade 13 fits directly under the head of the stopper 8 or 8a. The width of the upper and lower slots 20 and 20a are slightly wider than the stem of any stopper 8 or 8a. With the upper and lower blades 13 and 13a in this alternate position, increased separating action is provided between stopper 8 or 8a and bottle 8b. Additionally, with the stopper 8 or 8a positioned closer to the pivot 5, the leverage capability of the stopper extractor 1, is increased.

Figure 9:
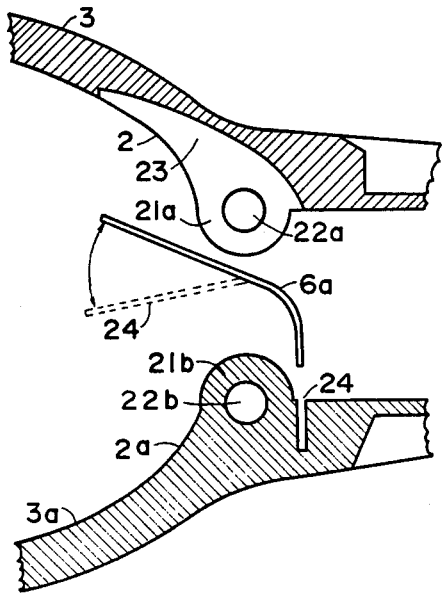
Figure 10:
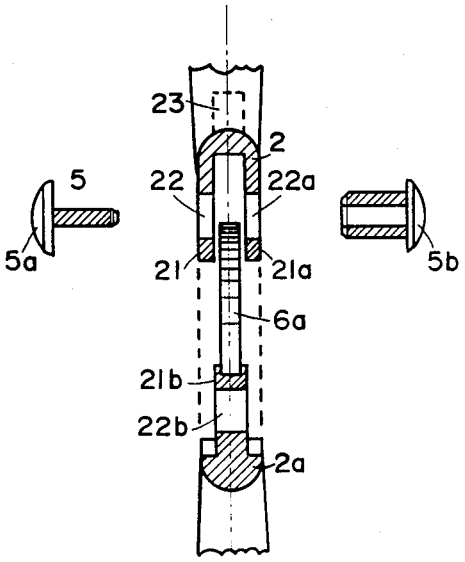

Referring to FIGS. 9 and 10, side and cross sectional views of an improved hinge and spring mechanism are also illustrated. The pivot pin assembly 5 is comprised of male and female fasteners 5a and 5b which press fit together. The upper lever 2 has two hubs 21 and 21a. The lower lever 2a has one hub 21b. The width of the lower hub 21b is sufficient to allow it to rotate firmly yet easily between upper hubs 21 and 21a. The pivot pin assembly 5 slides through equally sized holes 22, 22a and 22b in all three hubs, 21, 21a and 21b, thereby locking together the upper and lower levers, 2 and 2a. This hinge improvement eliminates any possibility that the upper and lower levers 2 and 2a might bind or become loose at the pivot interconnection because the pivot pin assembly 5 was initially fastened too tight or eventually became too loose.

Furthermore, this hinge modification enables the insertion of a hidden spring 6a to replace the exposed spring 6 which would otherwise be placed between the handles 3 and 3a. A slot 23 is located between the two upper hubs 21 and 21a, extends into the underside of the upper handle 3. The slot 23 provides space for a spring 6a preferably of flat steel. The spring 6a is anchored into a hole 24 located directly in front of the lower hub 21b. When the handles 3 and 3a are squeezed together, the spring 6a bends to its fully deflected position 24. When the handles 3 and 3a are released, the spring 6a returns levers 2 and 2a to their normal position by exerting upward force on the upper handle 3.

The invention in its broader aspects is not limited to the specific embodiments herein shown and described, but departures such as those described and others not described, may be made therefrom without departing from the principals of the invention and without sacrificing its chief advantages over devices presented in prior art.

What is claimed is:

1. In an extractor for extracting a mushroom shaped stopper from the neck of a sparkling beverage bottle, there being an upwardly presented shoulder on said neck, there being a downwardly presented and openly accessible shoulder on said stopper, and said extractor comprising a pair of levers which are pivotally interconnected, each lever defining a handle at one end thereof and a bifurcated jaw having a first recess at the opposite end thereof, wherein one jaw is located above the other, and each of said jaws is adapted to encircle, at least partially, the bottle's neck, such that the lower jaw is adapted to make contact with said upwardly presented shoulder on at least two locations, and the upper jaw includes a stopper retaining means and is adapted to make contact with said downwardly presented shoulder on at least two locations, with said handles being spring-loaded and positioned relative to one another so that the squeezing together of said pair of handles results in the separation of said jaws, urging said lower jaw against said upwardly presented shoulder and urging said upper jaw against said downwardly presented shoulder, and with force sufficient to lift said stopper relative to said neck, the improvement which comprises:

a generally U-shaped second recess within the interior of each of said bifurcated jaws wherein said extractor can be repositioned with both of said second recesses encircling, at least in part, the stem of a partially lifted stopper, thereby enabling said lower jaw to rest directly of top of said bottle and said upper jaw to gain increased accessibility to said stopper's downwardly presented shoulder means.

2. The device as in claim 1, wherein said jaws contain rib means along the outer perimeters of said jaws for strengthening said jaws.

3. The device as in claim 1, wherein said upper and lower jaws are curved inward at the mouth of both said first recess for guiding the insertion of said jaws around said bottle.

4. The device as in claim 1, wherein said stopper retaining means is a generally inverted U-shaped hood having opposite ends attached to the prongs of said bifurcated upper jaw, wherein said hood is made from a flexible material that is capable of being sufficiently collapsed to make contact with the head of said stopper, enabling a downwardly directed and manually exerted counter force to be applied to said stopper.

5. The device as in claim 1, wherein said stopper retaining means is a rigid arm that extends over the top of said stopper, and said arm is attached where said levers are pivotally interconnected, thereby enabling said arm to swivel downward so to make contact with the head of said stopper, thereby permitting a downwardly directed and manually exerted counter force to be applied to said stopper.

6. The device as in claim 1, wherein one or more spring loaded clips are attached to said upper jaw specifically for clamping the head of said stopper.

7. The device as in claim 1, wherein one or more spring loaded clips are attached to said stopper retaining means specifically for clamping the head of said stopper.

8. The device as in claims 5, wherein said stopper retaining means is spring loaded for clamping the head of said stopper.

9. The device as in claim 1, wherein said pair of handles contains grip means for gripping and twisting the head of said stopper.

10. The device as in claim 1, wherein said pivotal interconnection between said pair of levers, contain interlocking hubs with one or more flat springs that are anchored at the base of said hubs to the first of said pair of levers, and extend between said hubs into a slot within the underside of said handle of the second said pair of levers.

11. In an extractor for extracting a mushroom shaped stopper from the neck of a sparkling beverage bottle, there being an upwardly presented shoulder on said neck, there being a downwardly presented and openly accessible shoulder on said stopper, and said extractor comprising a pair of levers which are pivotally interconnected, each lever defining a handle at one end thereof and a bifurcated jaw having a first recess at the opposite end thereof, wherein one jaw is located above the other, and each of said jaws is adapted to encircle, at least partially, the bottle's neck, such that the lower jaw is adapted to make contact with said upwardly presented shoulder on at least two locations, and the upper jaw includes a stopper retaining means and is adapted to make contact with said downwardly presented shoulder on at least two locations, with said handles being spring-loaded and positioned relative to one another so that the squeezing together of said pair of handles results in the separation of said jaws urging said lower jaw against said upwardly presented shoulder and urging said upper jaw against said downwardly presented shoulder, and with force sufficient to lift said stopper relative to said neck, the improvement which comprises:

said extractor, wherein said stopper retaining means is a generally inverted U-shaped hood having opposite ends attached to the prongs of said bifurcated upper jaw, wherein said hood is made from a flexible material that is capable of being sufficiently collapsed to make contact with the head of said stopper, enabling a downwardly directed and manually exerted counter force to be applied to said stopper.

12. In an extractor for extracting a mushroom shaped stopper from the neck of a sparkling beverage bottle, there being an upwardly presented shoulder on said neck, there being a downwardly presented and openly accessible shoulder on said stopper, and said extractor comprising a pair of levers which are pivotally interconnected, each lever defining a handle at one end thereof and a bifurcated jaw having a first recess at the opposite end thereof, wherein one jaw is located above the other, and each of said jaws is adapted to encircle, at least partially, the bottle's neck, such that the lower jaw is adapted to make contact with said upwardly presented shoulder on at least two locations, and the upper jaw includes a stopper retaining means and is adapted to make contact with said downwardly presented shoulder on at least two locations, with said handles being spring-loaded and positioned relative to one another so that the squeezing together of said pair of handles results in the separation of said jaws, urging said lower jaw against said upwardly presented shoulder and urging said upper jaw against said downwardly presented shoulder, and with force sufficient to lift said stopper relative to said neck, the improvement which comprises:

said extractor, wherein said stopper retaining means is a rigid arm that extends over the top of said stopper, and said arm is attached where said levers are pivotally interconnected, thereby enabling said arm to swivel downward so to make contact with the head of said stopper, thereby permitting said downwardly directed and manually exerted counter force to be applied to said stopper.

13. In an extractor for extracting a mushroom shaped stopper from the neck of a sparkling beverage bottle, there being an upwardly presented shoulder on said neck, there being a downwardly presented and openly accessible shoulder on said stopper, and said extractor comprising a pair of levers which are pivotally interconnected, each lever defining a handle at one end thereof and a bifurcated jaw having a first recess at the opposite end thereof, wherein one jaw is located above the other, and each of said jaws is adapted to encircle, at least partially, the bottle's neck, such that the lower jaw is adapted to make contact with said upwardly presented shoulder on at least two locations, and the upper jaw includes a stopper retaining means and is adapted to make contact with said downwardly presented shoulder on at least two locations, with said handles being spring-loaded and positioned relative to one another so that the squeezing together of said pair of handles results in the separation of said jaws, urging said lower jaw against said upwardly presented shoulder and urging said upper jaw against said downwardly presented shoulder, and with force sufficient to lift said stopper relative to said neck, the improvement which comprises:

said extractor, wherein one or more spring loaded clips are attached to said stopper retaining means specifically for clamping the head of said stopper.

14. The device as in claim 12, wherein said stopper retaining means is spring loaded for clamping the head of said stopper.

* * * * *